US005285977A

United States Patent [19]

Biagiotti

[11] Patent Number: 5,285,977

[45] Date of Patent: Feb. 15, 1994

[54] APPARATUS FOR CUTTING WEB MATERIAL

[75] Inventor: Guglielmo Biagiotti, Lucca, Italy

[73] Assignee: Fabio Perini S.p.A., Lucca, Italy

[21] Appl. No.: 856,445

[22] Filed: Mar. 24, 1992

[30] Foreign Application Priority Data

Apr. 3, 1991 [IT] Italy ..... FI/91/A 73

[51] Int. Cl.[5] ..... B65H 35/10

[52] U.S. Cl. ..... 242/56 R; 83/328

[58] Field of Search ..... 242/56 R, 56.8; 83/323, 83/327, 328; 225/105

[56] References Cited

U.S. PATENT DOCUMENTS 3,567,552 3/1971 Heuff et al. ..... 242/56 R X 4,487,377 12/1984 Perini ..... 242/56.8

4,687,153 8/1987 McNeil ..... 242/56.8

4,919,351 4/1990 McNeil ..... 242/56 R

*Primary Examiner*—John M. Jillions

*Assistant Examiner*—Paul T. Bowen

*Attorney, Agent, or Firm*—Francis J. Bouda

[57] ABSTRACT

A cutter for tear-severing a web (N) driven around a rotating roller (10) wherein recesses (25) carried by the roller (10) cooperate cyclically with projections (23) external to the roller (10). The web material (N) is stretched beyond its breaking point between the recesses and projections (25, 23) when the projections (23) penetrate the recesses (25) without mutual contact. The tension in the web material (N) is caused by friction between the web material and the rotating roller (10).

13 Claims, 3 Drawing Sheets

APPARATUS FOR CUTTING WEB MATERIAL

SUMMARY OF THE INVENTION

The invention relates to a method and an apparatus for severing web material driven around a rotating roller, for example, of a rewinder for the formation of small rolls or logs of paper or similar material from large size rolls.

In the paper converting industry for the production of logs of paper web such as toilet paper, kitchen towels, all-purpose wipers and the like, rewinding machines are used which, starting from one or more rolls of large diameter, produce, in rapid succession, logs having diameter equal to the final small rolls of paper. After the winding, the logs are cut transversely to obtain small rolls of the desired length.

In some types of rewinding machines, such as in the machine described in U.S. Pat. No. 4,487,377, the paper web is driven around a main winding roller which defines, together with a second winding roller and a diameter-control roller, a winding region in which the log is formed. When the winding of a log is completed, the web is separated by a cutting system which comprises a counter-blade disposed on the main winding roller and a blade disposed on a cutting roller. The cutting blade is cyclically moved close to the counter-blade for carrying out the cut, but is withdrawn clear of the counter-blade during the winding of the log.

In the machine described in U.S. Pat. No. 4,487,377, the cutting blade is flanked by two rubber pads which press the web against the main winding roller during cutting, so that the web is torn by the cutting blade which stretches the web beyond the breaking point thereof between the rubber pads. This machine is also provided with a pair of perforating cylinders which make transversal perforation lines on the web with pre-determined and constant pitch throughout the web length, to define the web sections which, in the final small roll, are individually detached by the user. The machine members are interconnected and synchronized in such a way that the cut made by the blade and counter-blade system is always in correspondence with a perforation line.

This prior machine makes it possible to obtain a finished product of high quality. However, due to the presence of the rubber pads on the sides of the blade, during cutting the machine members are subject to a dynamic stress with the generation of vibrations which may adversely affect the finished product and the service life of some of the machine members.

The object of the present invention is to provide a tear-severing method and apparatus which avoid the above-mentioned drawbacks caused by the contact between the rubber pads and the main winding roller, while ensuring a quality of the finished product equal or superior to that obtained with prior machines.

Substantially, the method according to the invention provides for one cooperating severing means to penetrate the other without mutual contact, whereby the web material is stretched beyond its breaking point between said severing means during their mutual interaction.

The apparatus, according to the present invention, comprises a roller on which the web material is driven, which roller is provided with first severing means, and a unit carrying second severing means able to cyclically cooperate with said first severing means to stretch the web material beyond the breaking point. According to the present invention, the first and second severing means are so constructed as to penetrate one into the other without mutual contact, while the web material is stretched beyond the breaking point between said two severing means. Any mechanical stress due to the direct physical contact between the first and second severing means is thus eliminated.

In practice, severing is carried out by providing three projections, substantially parallel to each other, which interact cyclically with three corresponding channels or recesses which interact without direct contact while the web material is stretched between these members. Advantageously, the central projection may project a greater extent than the two side projections so that, while the side projections retain the web by forming two loops, the central projection causes the tearing of the web.

In a particularly advantageous embodiment of the apparatus according to the invention, the two side projections have different lengths in the radial direction.

In particular, the projection which first enters its respective channel (i.e., the projection ahead in the web feeding direction) is shorter than the other two projections. In this way, a more regular operation of the apparatus is obtained.

Advantageously, the roller on which the web material is driven and on which the channels are disposed, has high-friction surface regions in proximity of the channels. In this way there is avoided the sliding of the web material long the surface of the roller on which the web is in contact, so that tearing of the web material takes place exactly in correspondence of the severing means also when, for whatever reason, there is no perforation line in said region. This may occur either because the web is wound without perforations thereon, or because, for whatever reason, a perforation line is not present just where the cut is to be performed.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
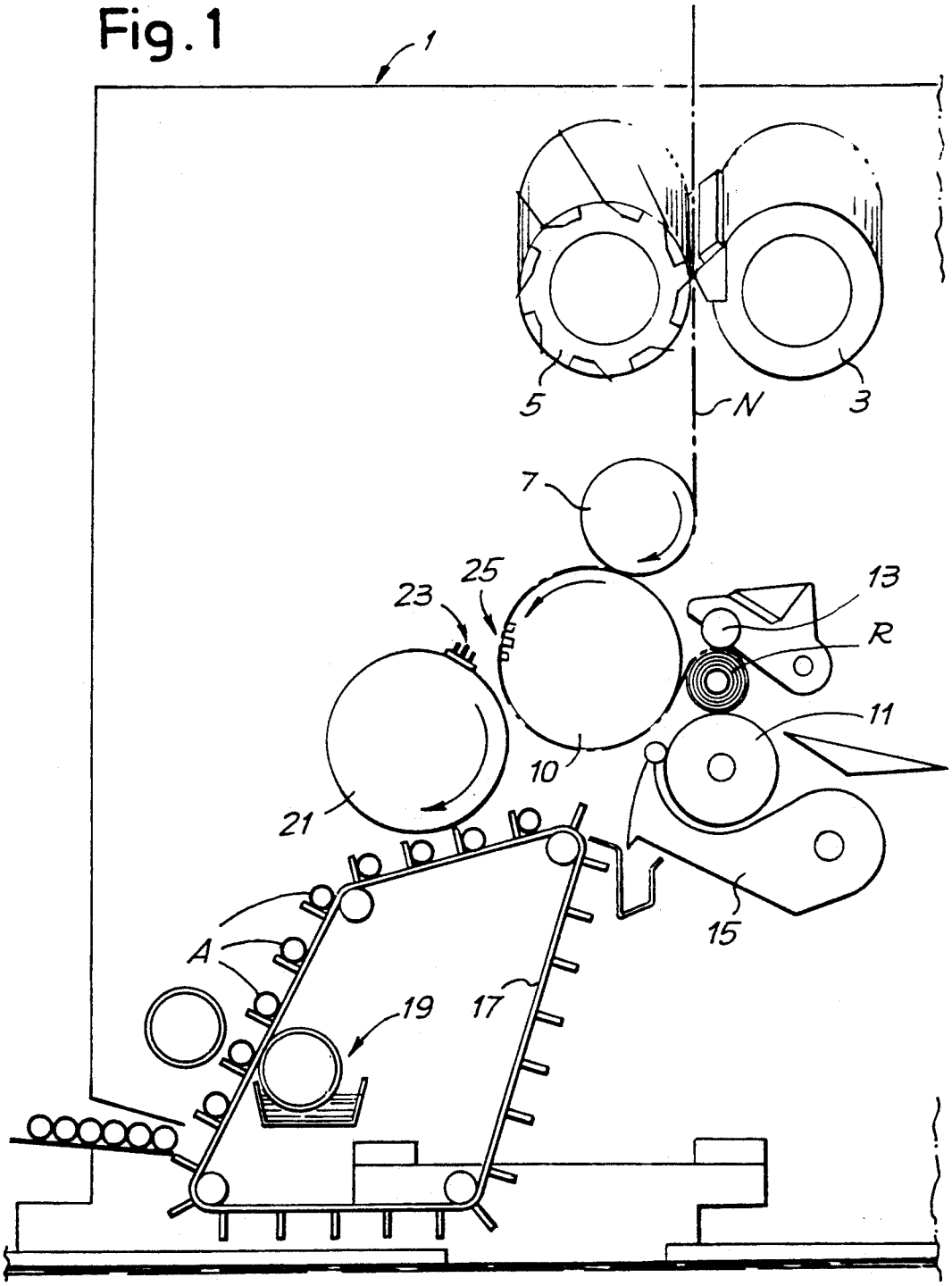
FIG. 1 shows a schematic layout of a rewinder in which the apparatus according to the invention may be embodied.

By first referring to FIG. 1, the rewinder generally indicated by 1 is provided with a pair of perforating rollers 3, 5 carrying a blade and one or more counter-blades respectively, for creating a series of transversal perforations in the web N, which perforations define the tear lines of the web. Disposed downstream of the perforating rollers 3, 5 is a driving cylinder 7 and a main winding roller 10, the structure and operation of which are described in U.S. Pat. No. 4,487,377. The winding roller 10 differs from that described in the U.S. patent as far as the severing means of the web N is concerned, as will be described in detail later on.

The web N is moved around the roller 10 and wound on a core to form a roll or log R within a winding space which is defined by the roller 10, a lower winding roller 11 and a diameter controlling roller 13. A core inserting means 15 picks up the cores A from a continuous conveyor 17 to insert them into the nip defined by the main roller 10 and the lower winding roller 11. Combined to the conveyor 17 is a device generally indicated by 19 for distributing glue over the surface of cores A.

Combined to the main roller 10 is a severing cylinder 21 provided with a severing means 23 to be described below in more detail. The severing cylinder is made to oscillate periodically towards the main roller 10 to bring the first severing means 23 into cooperation with a second severing means 25 located on the main roller 10, in order to sever the web N in the manner described hereinbelow. Said severing takes place when winding of roll R has been completed and prior to the insertion of the next core for beginning the winding of the subsequent roll. The rotary motion of the severing cylinder 21 is coordinated with the rotation of the main roller 10 in the known way as described in U.S. Pat. No. 4,487,377, so as to maintain the two elements in phase and thus ensuring that the severing means 23 of the cutting cylinder 21 will cooperate properly all the time with the severing means provided on the main roller 10.

Instead of a movable severing cylinder 21 a configuration may be provided such as the one described in the Italian Patent No. 1,213,822 in which a cutting cylinder, rotating about a fixed axis, carries a blade system which projects periodically from the surface of said cylinder towards the main roller.

Figure 2:
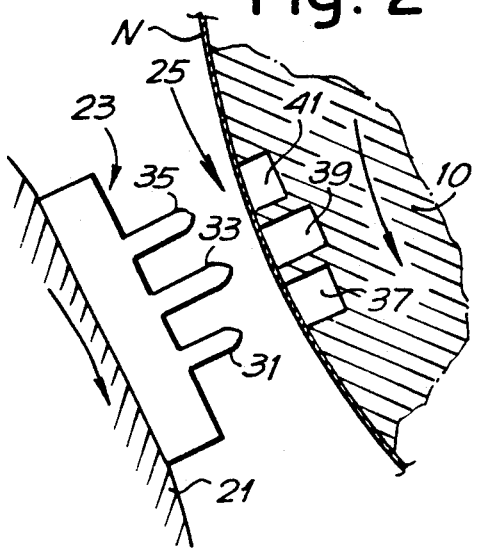
FIGS. 2 to 9 are schematic representations of the severing means in successive operating positions.
Figure 3:
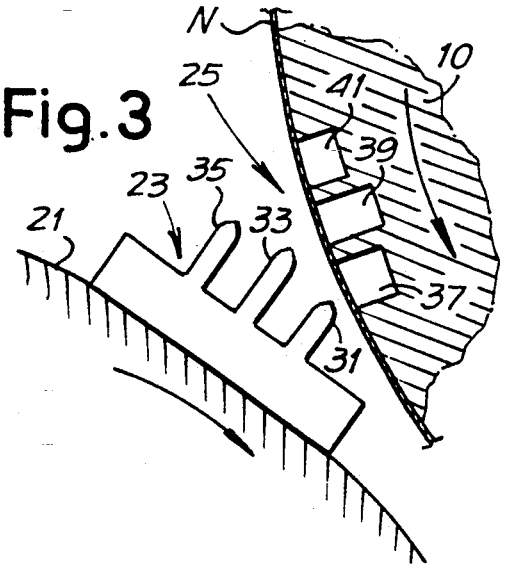
Figure 4:
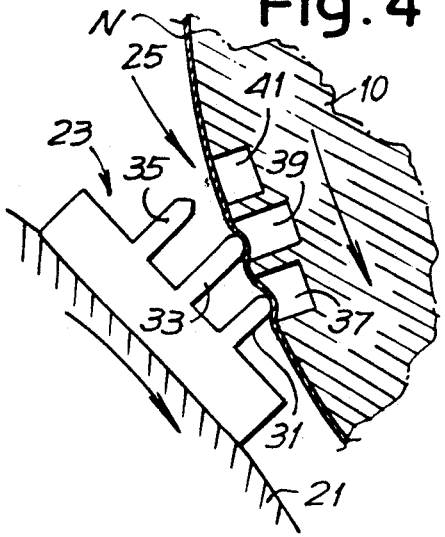
Figure 5:
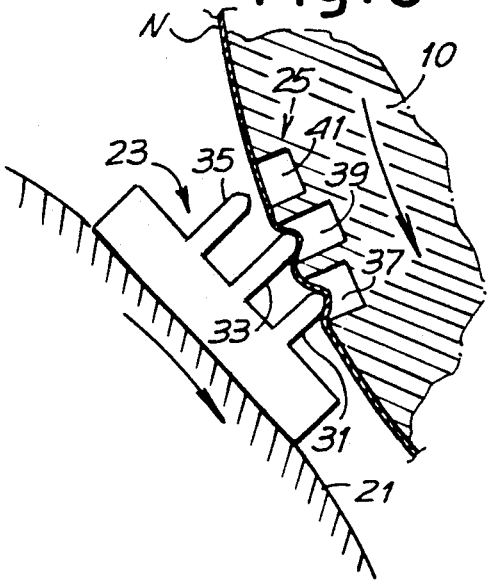
Figure 6:
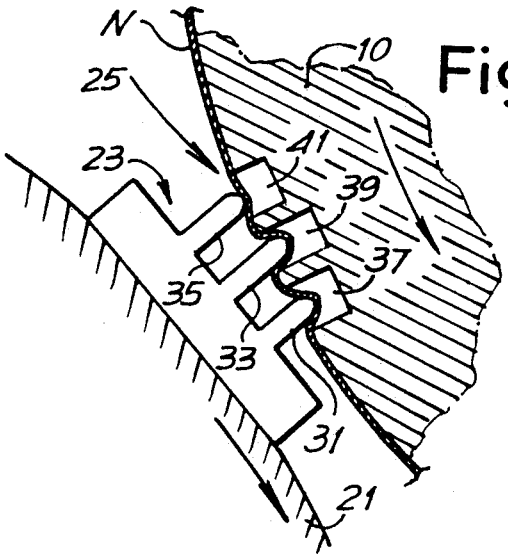
Figure 7:
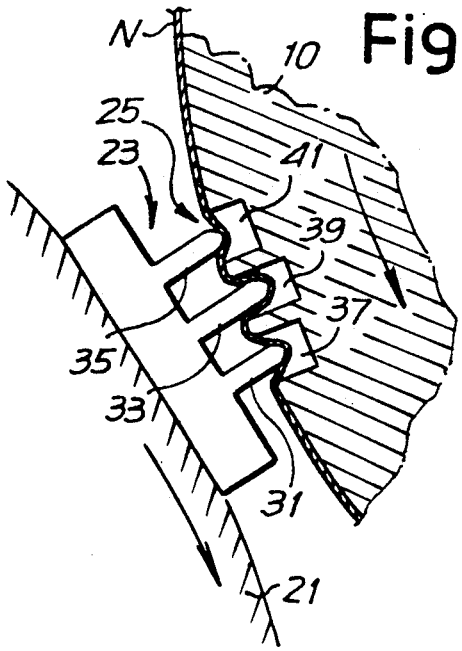
Figure 8:
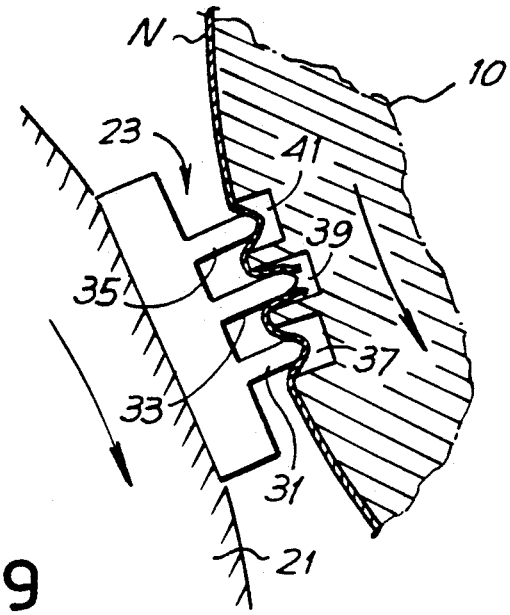

FIGS. 2 to 9 are enlarged views of the region of the main roller 10 with the severing means 25 therein, and the severing means 23 carried by the severing cylinder 21. FIG. 2 shows these members in their relative position during winding, both the severing means 23 and the severing-blade means 25 rotating at the same surface speed about their relevant axis of rotation.

FIGS. 3 to 9 show the same members as indicated in FIG. 2 in different instants during severing of web N. In the following text, the severing means 23 are referred to as "blades", but it is understood that this term designates more generally a projection, possibly blunt rather than sharp, which cooperates with a channel which may, generally speaking, be a recess in the main roller 10.

As schematically illustrated in FIGS. 2 to 9, the severing means 23 comprises three projections or blades 31, 33, 35 which are substantially parallel to each other and have an edge which extends substantially along the longitudinal development of the cylinder 21 or, at least, over a length sufficient for cutting the entire width of the web N. The three projections 31, 33, 35 cooperate with channels 37, 39, 41 provided on the main roller 10. The severing means 37, 39, 41 are made in the form of channels whose dimensions, as well as the dimensions of the projections 31, 33, 35, are such that the blades or projections never touch the channels, whatever mutual positions they may take during the cutting operation, as clearly shown in FIGS. 3 to 9.

The blade 31, i.e., the projection ahead in the feeding direction of web N, and thus the first to enter the relevant channel 37, is shorter than the remaining blades 33 and 35, while the intermediate blade 33 is longer than the side blades 31 and 35. As the blades 31, 33, 35 begin to penetrate the respective channels 37, 39, 41, the web N undergoes such an elongation in correspondence of the blades 31, 33, 35 as to exceed the breaking point of the web. This may take place in correspondence of a transversal perforation line which, through a suitable adjustment and phasing of the machine members, is very near the vertex of the central blade 33, where the web undergoes the maximum elongation.

Figure 9:
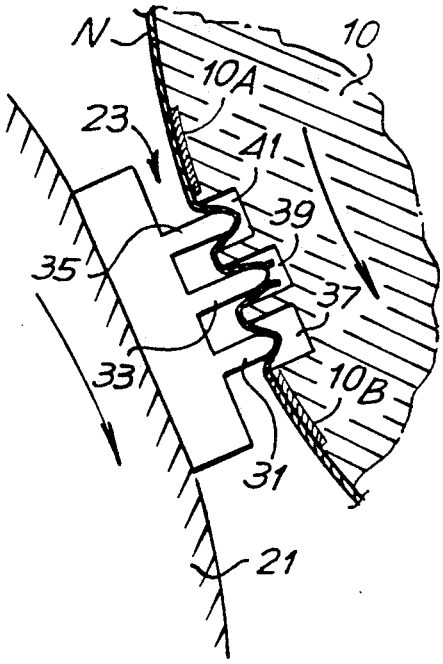

To ensure the tearing of the web along a perforation line when the latter is not exactly positioned at the vertex of the central blade 33, or if (for whatever reason) there is no perforation in the severing region between blades 31 and 35, provision is made for advantageously enhancing the coefficient of friction of the surface regions 10A and 10B of the roller 10 which are adjacent to channels 37 and 41, as schematically represented in FIG. 9. This may be obtained, for example, by applying a granular abrasive or other suitable material on the surface of roller 10, or within a groove suitably formed thereon, so that the outer surface of the high-friction area will be of the same diameter as the rest of the surface of roller 10. The regions of high coefficient of friction 10A and 10B prevent the web N from sliding with respect to the surface of roller 10, so that the elongation of the web is localized in the severing zone, thereby ensuring the tearing also in the absence of perforation.

Figure 10:
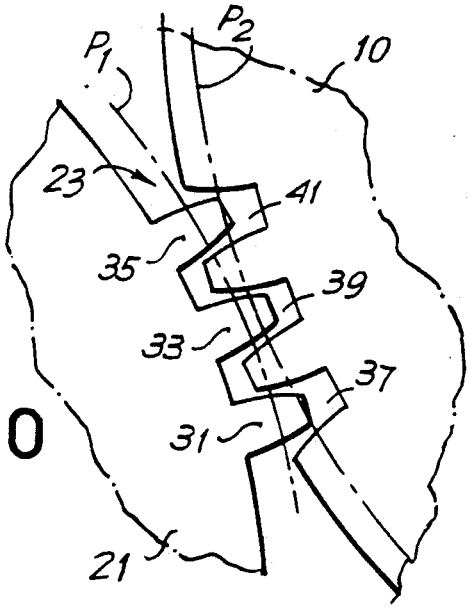
FIG. 10 shows an embodiment of the present invention more like gear-teeth than blade and channel construction.

FIG. 10 shows an improved embodiment of the cutting means. In this embodiment, projections 31, 33, 35 are in the form of gear teeth, i.e., they have a profile corresponding to an involute. The channels 37, 39, 31 are formed by corresponding recesses between adjacent gear teeth. The pitch lines corresponding to the two sets of teeth are shown at P1 and P2 in FIG. 10. As can be seen from this Figure, when the teeth 31, 33, 35 penetrate the channels 37, 39, 41, the two pitch lines are not in contact, as it normally happens in gear transmissions. Thus, the profiles of the teeth forming the blades and the channels are not in mutual contact. The paper web is not shown in FIG. 10 for the sake of clarity.

It is to be understood that the present invention may be embodied in other specific forms without departing from the spirit or special attributes hereof, and it is therefore desired that the present embodiments be considered in all respects as illustrative, and therefore not restrictive, reference being made to the appended Claims rather than to the foregoing description to indicate the scope of the invention.

Having thus described my invention, what is claimed as new and desired to protect by Letters Patent are the following:

1. An apparatus for cutting web material (N), comprising a roller (10) to drive the web material (N), provided with first cutting means (25), and a unit (21) carrying second cutting means (23), able to cyclically cooperate with said first cutting means (25) to cause the web material (N) to undergo an elongation beyond the breaking point, characterized in that said first cutting means (25) and said second cutting means (23) are so constructed as to penetrate one into the other without mutual contact, the web material (N) being subjected to stretching and rupture by the mutual penetration of said first and second cutting means (25, 23), the friction between the web material (N) and the roller (10) keeping the web in tension, and wherein said first and second cutting means (23, 25) comprise a plurality of recesses (37, 39, 41) substantially parallel to each other, and a plurality of projections (31, 33, 35) able to penetrate into said recesses, and wherein said first cutting means (25) comprise three recesses (37, 39, 41) substantially parallel and close to each other, and said second cutting means (23) comprise three projections (31, 33, 35) able to cooperate with said recesses, and wherein the central projection (33) has a length in radial direction greater than said side projections (31, 25).

2. An apparatus according to claim 1, characterized in that the lateral projections (31, 35) have different lengths in radial direction, the projection (31) ahead with respect to the direction of advancement of the web material (N) being shorter than the rearest projection (35).

3. An apparatus according to claim 1 characterized in that the second cutting means (23) are borne by a cutting cylinder (21) which rotates in synchronism and in phase with said roller (10) on which the web material (N) is driven.

4. An apparatus according to claim 3, characterized in that said cutting cylinder (21) is movable to be cyclically brought close to the roller (10) onto which the web material (N) is driven.

5. An apparatus according to claim 3, characterized in that said second cutting means (23) are movable with respect to the cutting cylinder (21) which rotates about a fixed axis.

6. An apparatus according to claims 1, characterized in that, on the surface of said roller (10) onto which the web material (N) is driven, a material (10A, 10B) is applied, in proximity of the cutting means (25) and on both sides thereof, which material is able to increase the friction between said roller (10) and the web material (N).

7. A rewinder comprising means (10, 11, 13) for winding rolls (R) of web material (N) and means (7, 8, 10) for driving said web material (N), characterized in that it comprises an apparatus according to claim 1 for cutting the web material (N) at the end of winding every single roll (R).

8. An apparatus for cutting web material (N) including:

a rotating roller (10) to drive the web material (N);

a central recess (39) and two parallel side recesses (37, 41) within the cylindrical surface of said roller (10);

a unit (21) carrying a central projection (33) and two parallel side projections (31, 35) able to cyclically cooperate with said recesses (37, 39, 41) wherein;

said central projection (33) has a length in radial direction greater than said side projections (31, 35);

the recesses and the projections are arranged to penetrate one into the other without mutual contact;

the web material (N) being subjected to stretching and rupture by the penetration of said projections into said recesses, the friction between the web material (N) and the roller (10) keeping the web in tension.

9. An apparatus according to claim 8, characterized in that the lateral projections (31, 35) have different lengths in radial direction, the projection (31) ahead with respect to the direction of advancement of the web material (N) being shorter than the rearest projection (35), 10. An apparatus according to claim 8 or 9, characterized in that, on the surface of said roller (10) onto which the web material (N) is driven, a material (10A, 10B) is applied, in proximity of the recesses (37, 39, 41) and on both sides thereof, which material is able to increase the friction between said roller (10) and the web material (N).

11. An apparatus according to claim 8, characterized in that the projections (31, 33, 35) are borne by a cutting cylinder (21) which rotates in synchronism and in phase with said roller (10) on which the web material (N) is driven.

12. An apparatus according to claim 11, characterized in that said cutting cylinder (21) is movable to be cyclically brought close to the roller (10) onto which the web material (N) is driven.

13. An apparatus according to claim 11, characterized in that said projections (31, 33, 35) are movable with respect to the cutting cylinder (21) which rotates about a fixed axis.

* * * * *